United States Patent [19]

Kingsley

[11] 4,180,045

[45] Dec. 25, 1979

[54] COMPOUND BOW STRINGING

[75] Inventor: Charles E. Kingsley, Evanston, Ill.

[73] Assignee: Arens Controls, Inc., Evanston, Ill.

[21] Appl. No.: 904,908

[22] Filed: May 11, 1978

[51] Int. Cl.[2] ..... F41B 5/00

[52] U.S. Cl. ..... 124/90; 29/235

[58] Field of Search ..... 29/235; 124/23 R, 90, 124/80, 24 R, 86, 22

[56] References Cited

U.S. PATENT DOCUMENTS 4,050,137 9/1977 Carlson ..... 29/235

*Primary Examiner*—Robert L. Spruill
*Assistant Examiner*—Roscoe V. Parker
*Attorney, Agent, or Firm*—Trexler, Wolters, Bushnell & Fosse, Ltd.

[57] ABSTRACT

The cables on a compound bow are provided at the ends thereof with double ears, hooks or anchors whereby a new bow string may readily be applied before the old string is removed or severed.

5 Claims, 6 Drawing Figures

Fig. 1
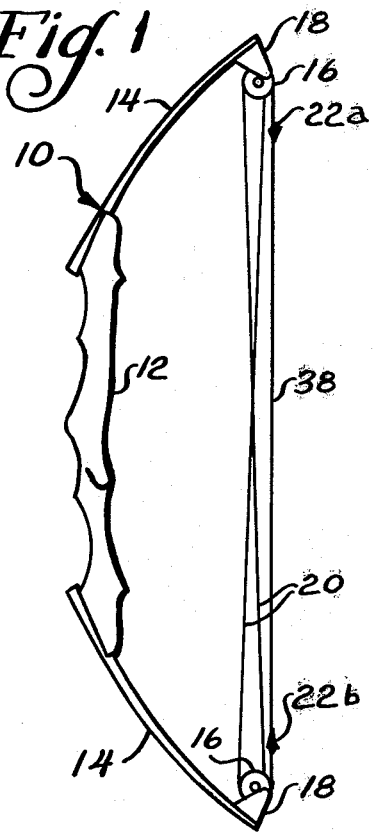
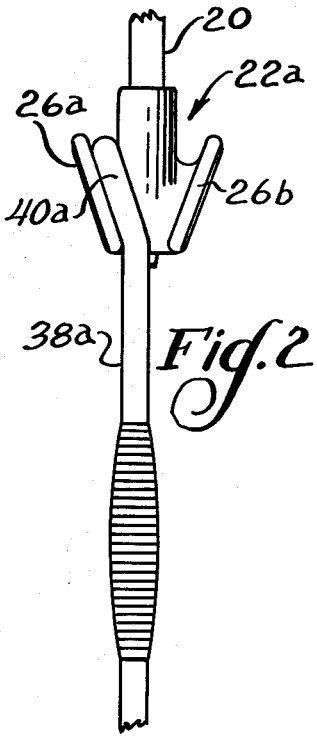
Fig. 2
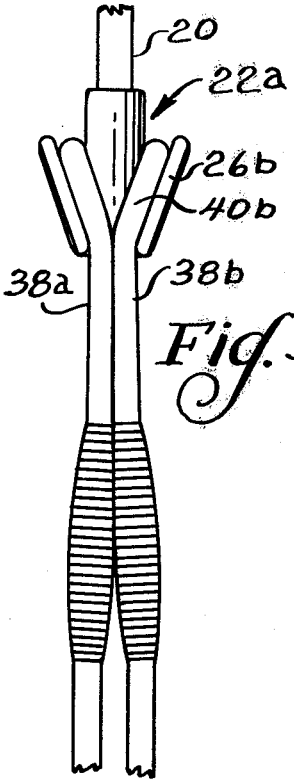
Fig. 3
Fig. 4
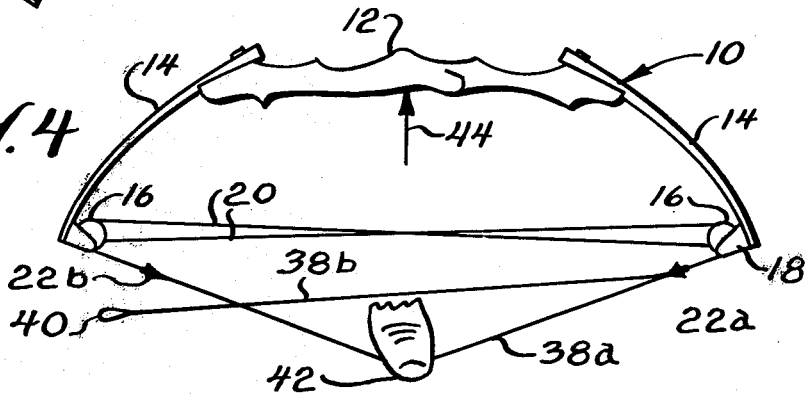
Fig. 5
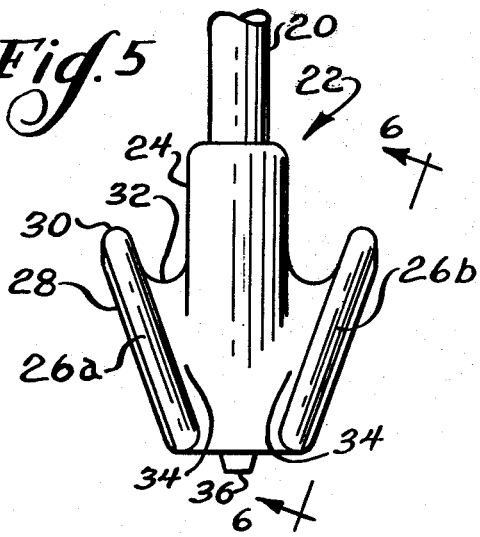
Fig. 6
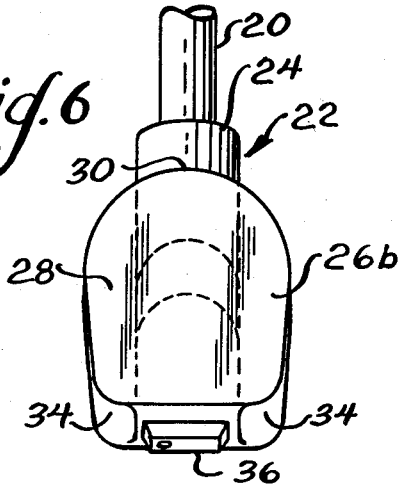

COMPOUND BOW STRINGING

BACKGROUND OF THE INVENTION

Bows for shooting arrows for target practice, for hunting, or for warfare have been known since before the dawn of recorded history. Conventional bows comprise a resilient length of wood or the like deformed from straight position and having a bow string secured to the ends. An arrow is positioned with its rear end on the string and the balance of the arrow along the center of the bow. The arrow and string are then pulled back and released for propulsion of the arrow. Such bows have a marked disadvantage in that the greatest tension, and hence the greatest propulsive effect are when the bow is bent to its greatest bending position. This makes it very difficult to hold an arrow in ready position, and it is inefficient in propelling the arrow in that the greatest force comes at the start, with the forced subsequently decreasing when it would be better for the force to increase insofar as propulsion efficiency is concerned.

Many of the problems of conventional bows have been solved by the use of compound bows which are well known in the art. Compound bows have a non-bending center section for gripping by the hand, and resilient outer ends which may be of metal, wood, or fiberglass reinforced resin. Pulleys are mounted at the ends of the bows, and cables are laced back and forth under tension through the pulleys with ends thereof provided with anchors of some sort for receipt of a bow string. Restringing of such bows is rather difficult, since it is not an easy thing to deflect the bow ends sufficiently, as to cause a reduction in the cable tension required for the restringing or destringing of the bow.

Articles generally known as bow stringers or bow string changers have been developed comprising a wire or cord with devices at either end that are designed to grab the cables adjacent to the ends and thru operator leverage bring and hold the cables ends closer together allowing reduced tension on the bow string for removal and restringing. Use of such a bow stringer requires the archer to carry this extra part, and also costs him an expenditure of $3.00 to $6.00 and up simply for an aid in stringing his bow.

OBJECTS AND SUMMARY OF THE PRESENT INVENTION

It is an object of the present invention to provide a method of and structure for restringing a compound bow without the necessity of carrying the extra part.

Specifically, it is an object of the present invention to provide anchors on the cables of a compound bow capable of simultaneously mounting two bow strings. Accordingly, all that is necessary is to step on the old bow string to relax the bow, thereby bringing the anchor points closer together, whereby a new bow string can be installed. Subsequently, the second bow string is stepped on to relax the bow while the old bow string is removed.

In accordance with the principles of the present invention the existing anchors on the ends of the cable of a compound bow are replaced by anchors having double hooks or bow string retention areas for the simultaneous receipt of two bow strings.

DRAWING DESCRIPTION

The structure of the present invention as well as the objects and advantages thereof will best be understood with reference to the following specification when taken in connection with the accompanying drawings wherein:

FIG. 1 is a side view of a compound bow constructed in accordance with the principles of the present invention;

FIG. 2 is an enlarged fragmentary view showing receipt of a bow string on the anchor at the end of a cable in accordance with the present invention;

FIG. 3 is a view similar to FIG. 2 showing two bow strings simultaneously retained by the anchor;

FIG. 4 is a side view showing application of a second string to the bow;

FIG. 5 is an enlarged front view of the bow string anchor in accordance with the present invention; and FIG. 6 is a view taken substantially at right angles to FIG. 5 along the line 6—6 of FIG. 5.

DETAILED DISCLOSURE

Referring now to the drawings in greater particularity there will be seen a compound bow 10 of generally conventional construction including a rigid center or hand gripping portion 12 and outer flexible or resilient ends or arms 14. A pulley 16 is mounted at the outer extremity of each arm by means of a bracket 18. A pair of cables 20 are mounted on the bow, each having one end secured adjacent one extremity of the bow (not shown) and having looped over the opposite pulley. Up to this point the bow is of conventional construction for a compound bow. The cable conventionally is nylon covered steel, but any sort of cable suitable for compound bows is suitable for use with the present invention.

Each end of the cables 20 is provided with an anchor 22. For purposes of distinction in FIGS. 1 and 4, where both anchors are shown, one anchor is designated as 22A and the other as 22B, although both are identical.

As specifically illustrated herein each anchor 22 comprises a die casting as of zinc alloy cast directly on the end of a respective cable. As best seen in FIGS. 5 and 6 each anchor comprises a central longitudinal sleeve or ferrule 24 which receives the appropriate cable end. It will be understood that the anchor could be of other material and suitably secured to the cable. The anchor is laterally symmetrical (FIG. 5) and comprises a left hook 26A and a similar right hook 26B. Each hook comprises a generally flat plate section 28 diagonally arranged relative to the ferrule or sleeve 24 with the end thereof relatively remote from the cable 20 closest to the longitudinal center line of the anchor and the opposite end spaced further from the center line. The opposite or free end 30 is in each instance rounded and is spaced from the ferrule 24 by a recess 32 which extends also down the sides of the plates 28 as shown at 34. A trapezoidal projection 36 is left at the extremity of each anchor as an incident to casting of the metal in the die.

The compound bow 10 is strung with a conventional compound bow string 38 having loops 40 at both ends. Such bow strings are sometimes made of cotton and sometimes of plastic, and which is used is immaterial to the present invention. In FIGS. 2–4 the suffixes A and B are used to designate different bow strings, and in FIG. 2 a single bow string 38A is shown with one loop 40A thereof received over the corresponding hook 26A of the anchor 22A. If the bow string should become worn, or if it is otherwise desired to replace the bow string, then the bow is placed in a position shown in FIG. 4, and the archer's foot 42 is placed against the mid-section of the bow string 38A, while an upward force is exerted by the archer's hand in the position indicated by the arrow 44. This flexes the resilient end portions 14 of the bow and pulls the anchors 22A and 22B closer together. Accordingly, a second bow string 38B may be looped over the hook 40B (FIG. 3), and it will be seen in FIG. 4 that the bow string 38B is longer than the distance between the two anchors 22A and 22B, whereby the loop 40 at the opposite end readily may be secured over the second hook portion of the anchor adjacent thereto.

Tension on the bow is then relaxed and the two strings will be pulled out in immediate contiguity to one another as shown in FIG. 3. It is then only necessary to step on the new bow string and again to lift the center portion of the bow to cause bending of the extremities of the bow toward one another, whereby the old bow string may be removed in exactly the opposite procedure of installation of the new one.

Although hook like structures heretofore have been used for securing the bow strings on a compound bow, to the best of my knowledge there has never heretofore been a double hooked anchor permitting installation of two bow strings at the same time. The specific example of the anchor as herein shown and described is exemplary only, and any bulk cable and that allows two bow strings to be mounted at the same time is the essential feature. The anchor has been described as being symmetrical, and this provides better balance, and hence better action of the bow. It provides better alignment of the cable center line and the center of the anchor.

The method of compound bow stringing as herein shown and described is the fastest and most efficient way of restringing. As is known, and hence not illustrated herein, nocking points are often applied to a bow string to aid the archer in accurately positioning the rear end of an arrow on the string for shooting different distances, etc. The present method and article allow ready switching of strings back and forth for different purposes, such having been so difficult as to be ignored in the past. Separate bow stringers or bow string changers are unnecessary, thereby avoiding the necessity of carrying a separate piece which readily may be lost. It is also unnecessary to provide accessories on the bow ends or limbs to relax tension for restringing. The present method of bow stringing also helps to impress on the archer's mind that he should change his string when it starts to fray and should not wait for the string to break. This is easy enough for an archer to do with the present restringing method, and avoids the dangers of ripping cable ends if a bow string is used too long and allowed to break.

It will be understood that it is not important to the method of restringing whether the first end of the second bow string is attached before or after flexing of the bow. The second end is of course attached with the bow flexed. Similarly, it is not essential that the bow be flexed a second time for removal of the first bow string. If the bow string has started to show wear and should be discarded in any event, then the first bow string may be cut for removal without flexing the bow a second time. It is obviously easiest to flex the bow as illustrated in FIG. 4 by displacing the bow string away from the bow, but at least from a theoretical standpoint the bow string could be displaced toward the bow, or laterally thereof, the only requirement being that the ends of the bow be pulled in toward one another whereby the anchors on the cables are moved closer together.

The specific example of the invention as herein shown and described is for illustrative purposes. Various changes will no doubt occur to those skilled in the art and will be understood as forming a part of the present invention insofar as they fall within the spirit and scope of the appended claims.

The invention is claimed as follows:

1. Structure for use in a compound bow of the type having cable means having spaced apart free ends, comprising an anchor on each of said free ends having a pair of like bow string receiving portions thereon for tensioning a bow string therebetween, there being a bow string of predetermined length and having anchor receiving loop portions adjacent opposite ends thereof tensioned between anchors and each anchor receiving loop portion being received on only one of each pair of bow string receiving portions, each of said anchors comprising an elongated body portion secured to a respective free cable end and having a longitudinal axis substantially in axial alignment with the adjacent portion of a respective cable, each bow string receiving portion having a narrow neck joined to said body and extending transversely thereof, and a bow string retainer joined to said neck and substantially coextensive therewith in the direction of said longitudinal axis, each said retainer substantially throughout its length being wider than the neck to which it is joined, each said retainer, neck and body forming a generally longitudinally extending channel-like recess to receive a bow string loop.

2. An anchor as set forth in claim 1 wherein each retainer is symmetric about the neck to which it is joined, four channel-like recesses thus being provided on each anchor.

3. An anchor as set forth in claim 2 wherein the retainer comprises a plate disposed diagonally at a shallow angle to said longitudinal axis, each plate being closer to said body adjacent to the end of said body remote from the respective cable means end.

4. An anchor as set forth in claim 1 wherein each said neck and retainer are diametrically opposite to one another whereby each said anchor is symmetrical.

5. The combination comprising a pair of anchors as set forth in claim 1 secured to the ends of cable means on a compound bow with said pair of anchors in spaced relation and temporarily having two like bow strings extending therebetween.

* * * * *